US007597519B2

(12) United States Patent
Aries et al.

(10) Patent No.: US 7,597,519 B2
(45) Date of Patent: Oct. 6, 2009

(54) BINDER

(75) Inventors: Paul Arthur Aries, West Midlands (GB); Ian Stuart Smith, Northants (GB)

(73) Assignee: ACCO UK Limited, Aylesbury (GB)

( * ) Notice: Subject to any disclaimer, the term of this patent is extended or adjusted under 35 U.S.C. 154(b) by 82 days.

(21) Appl. No.: 11/426,052

(22) Filed: Jun. 23, 2006

(65) Prior Publication Data

US 2007/0160445 A1 Jul. 12, 2007

(30) Foreign Application Priority Data

Jul. 4, 2005 (GB) ..... 0513572.8

(51) Int. Cl.
*B42B 9/00* (2006.01)
*B42B 5/08* (2006.01)
*B42B 5/00* (2006.01)

(52) U.S. Cl. ..... 412/40; 412/38; 412/33

(58) Field of Classification Search ..... 412/1, 412/6, 7, 11, 12, 20, 28, 33, 34, 38–40; 399/408
See application file for complete search history.

(56) References Cited

U.S. PATENT DOCUMENTS

| | | | | |
|---|---|---|---|---|
| 2,945,246 A | | 7/1960 | Duncan et al. | |
| 3,793,660 A | | 2/1974 | Sims | |
| 4,008,501 A | | 2/1977 | Cutter | |
| 4,872,796 A | * | 10/1989 | Hsieh et al. | 412/16 |
| 4,902,183 A | * | 2/1990 | Vercillo et al. | 412/7 |
| 5,211,522 A | | 5/1993 | Ho | |
| 5,419,668 A | * | 5/1995 | Ballist | 412/40 |
| 5,527,142 A | * | 6/1996 | Chih-Kwo | 412/38 |
| 5,584,632 A | * | 12/1996 | Stiles et al. | 412/39 |
| 5,971,689 A | * | 10/1999 | Scharer et al. | 412/33 |
| 6,079,924 A | * | 6/2000 | Chiang | 412/33 |
| 6,471,458 B1 | | 10/2002 | Soule | |
| 2006/0140744 A1 | * | 6/2006 | Chiang | 412/33 |

FOREIGN PATENT DOCUMENTS

| | | |
|---|---|---|
| DE | 19947257 | 4/2001 |
| EP | 0392512 | 10/1990 |
| GB | 1546543 | 5/1979 |
| WO | 0143898 | 6/2001 |

OTHER PUBLICATIONS

UK Search Report dated Sep. 23, 2005 for corresponding Application No. GB0513572.8
European Search Report and Search Opinion for corresponding European Application No. 06013233.9 mailed on Nov. 30, 2006.

* cited by examiner

*Primary Examiner*—Dana Ross
*Assistant Examiner*—Pradeep C Battula
(74) *Attorney, Agent, or Firm*—Michael Best & Friedrich LLP

(57) ABSTRACT

A binder is described which is operable to bind together pages of a document using a comb, the binder including a punch mechanism operable to punch a line of holes close to one edge of the pages of the document, and a comb opening mechanism to enable the punched pages to be placed on the comb, the comb opening mechanism having a user operable control. The binder further includes a user operable control for selection of the comb size to be used to bind the document which automatically determines at least two settings of the binder.

11 Claims, 3 Drawing Sheets

BINDER

BACKGROUND OF THE INVENTION

The invention relates to improvements in binders, particularly the selection of settings of the binder.

Binders are used for binding together the pages of many differently-sized documents. Generally, the document width and/or thickness must be known by a user, and settings of the binder selected accordingly. For example, the user measures the document width and thickness in some way, and then selects various settings of the binder to indicate, for example, the document width, the document thickness, the size of a back margin of the pages, the number of holes to be punched in the pages, and/or the size of comb (of plastic or wire) to be used to bind the pages. Generally, determination of the correct settings, and selection of each setting is carried out by the user. A number of the correct settings of the binder depend on the size of comb to be used to bind the document. The selection of the comb size and appropriate binder settings can be time-consuming, and if an incorrect combination of comb and settings is selected can lead to poor quality binding, and even damage to the pages of the document and/or the binder.

It is an aim of the present invention to assist the user in making the correct selection of settings, and thus to reduce the above described problems.

SUMMARY OF THE INVENTION

According to the present invention there is provided a binder operable to bind together pages of a document using a comb, the binder including a punch mechanism operable to punch a line of holes close to one edge of the pages of the document, and a comb opening mechanism to enable the punched pages to be placed on the comb, the comb opening mechanism having a user operable control, wherein the binder further includes:

a user operable control for selection of the comb size to be used to bind the document which automatically determines at least two settings of the binder.

The binder may further include a comb opening stop for controlling the degree to which the comb is held open by the comb opening mechanism, and the setting of the user operable control for selection of the comb size automatically determines the setting of the comb opening stop.

Conveniently the user operable control for the comb opening mechanism has a first stop formation and the user operable control for selection of the comb size includes a second stop formation, the second stop formation limiting the movement of the first stop formation, and thus the user operable control for the comb opening mechanism, dependent upon the setting of the comb size.

The binder may further include a back margin adjustment mechanism for setting the distance from the one edge of the pages of the document at which the holes are punched and the setting of the user operable control for selection of the comb size determines the setting of the back margin adjustment mechanism.

Preferably a drive mechanism links the user operable control for selection of the comb size to the back margin adjustment mechanism. The drive mechanism may include a first toothed wheel secured for rotation with the user operable control for selection of the comb size, a toothed belt, a second toothed wheel driven by the belt, the second toothed wheel providing cam surfaces for operation of a cam follower to operate the back margin adjustment mechanism.

Conveniently the user operable control for selection of the comb size, or a part secured for rotation with it, is marked with the different diameters of comb available, and the user sets the control on the basis of the document thickness.

The binder may further include means for measuring the document thickness. The means for measuring the document thickness may include a hopper into which the pages of the document to be bound are placed. The hopper conveniently has within it a scale onto which the pages of the document to be bound are placed and from which the document thickness can be read by a user.

Generally the punch mechanism is capable of punching a group of pages at one time, and thus the hopper conveniently has within it a comb, having upstanding teeth and indentations therebetween, onto which the pages of the document to be bound are placed such that alternate groups of pages are supported in the indentations and on the teeth, such that the user can readily pick up a group at once for punching, and each group is of the correct number of pages to be punched at one time by the punch mechanism of the binder.

An example of a binder according to the invention will now be described, by way of example only, with reference to the accompanying drawings in which.

The invention relates to a binder 10 of the kind which is operable to bind the pages of a document together by punching a line of holes close to one edge of the pages and then inserting a retention means in the holes. The embodiment which will be described is of the kind in which the retention means is a plastic comb which is held open whilst the punched pages are placed onto the teeth of the comb, and then released to retain the pages in place on the teeth.

DETAILED DESCRIPTION

Figure 1:
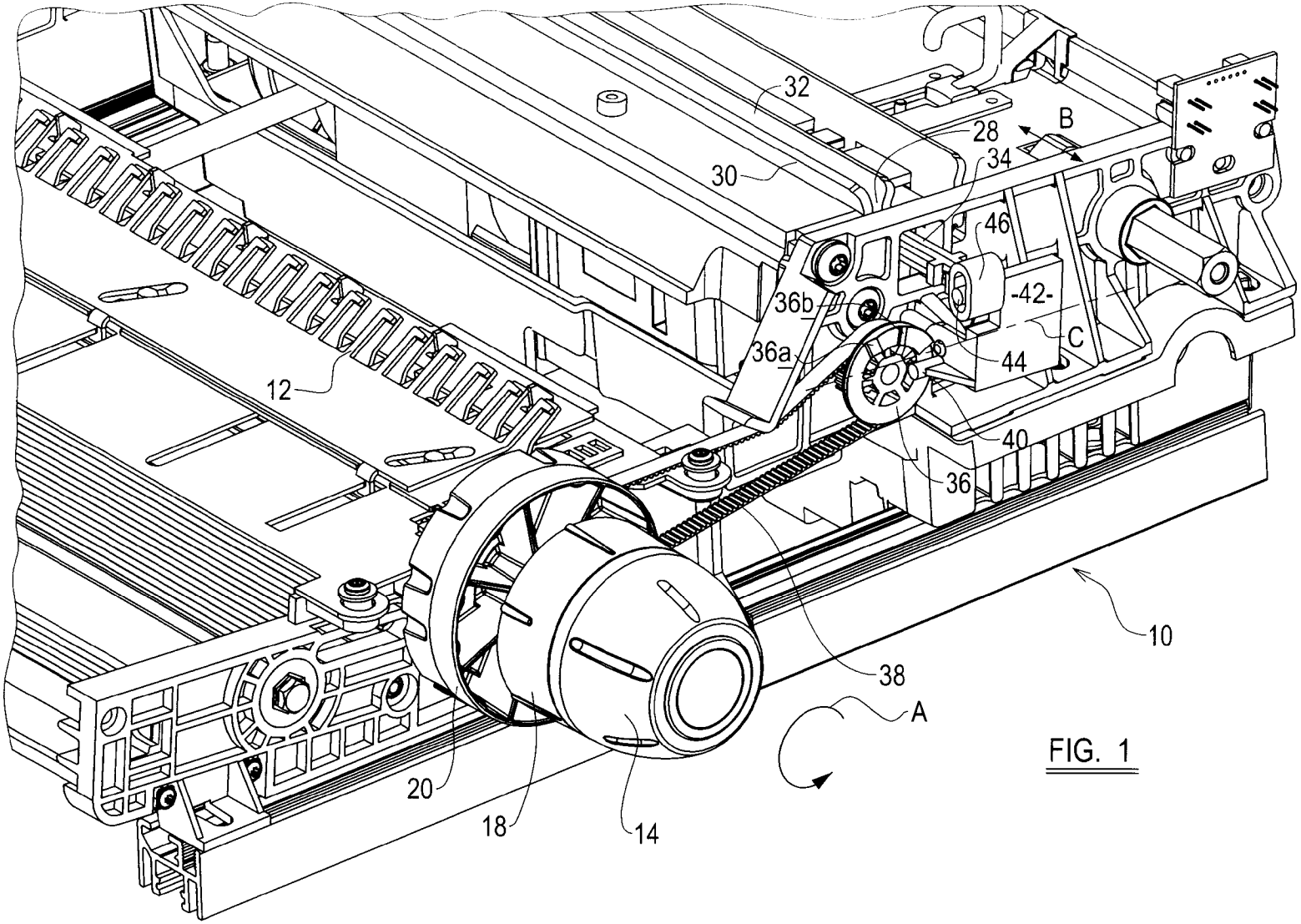
FIG. 1 is a close up view of part of the right hand side of a binder according to the invention, in particular the user operable controls.
Figure 2:
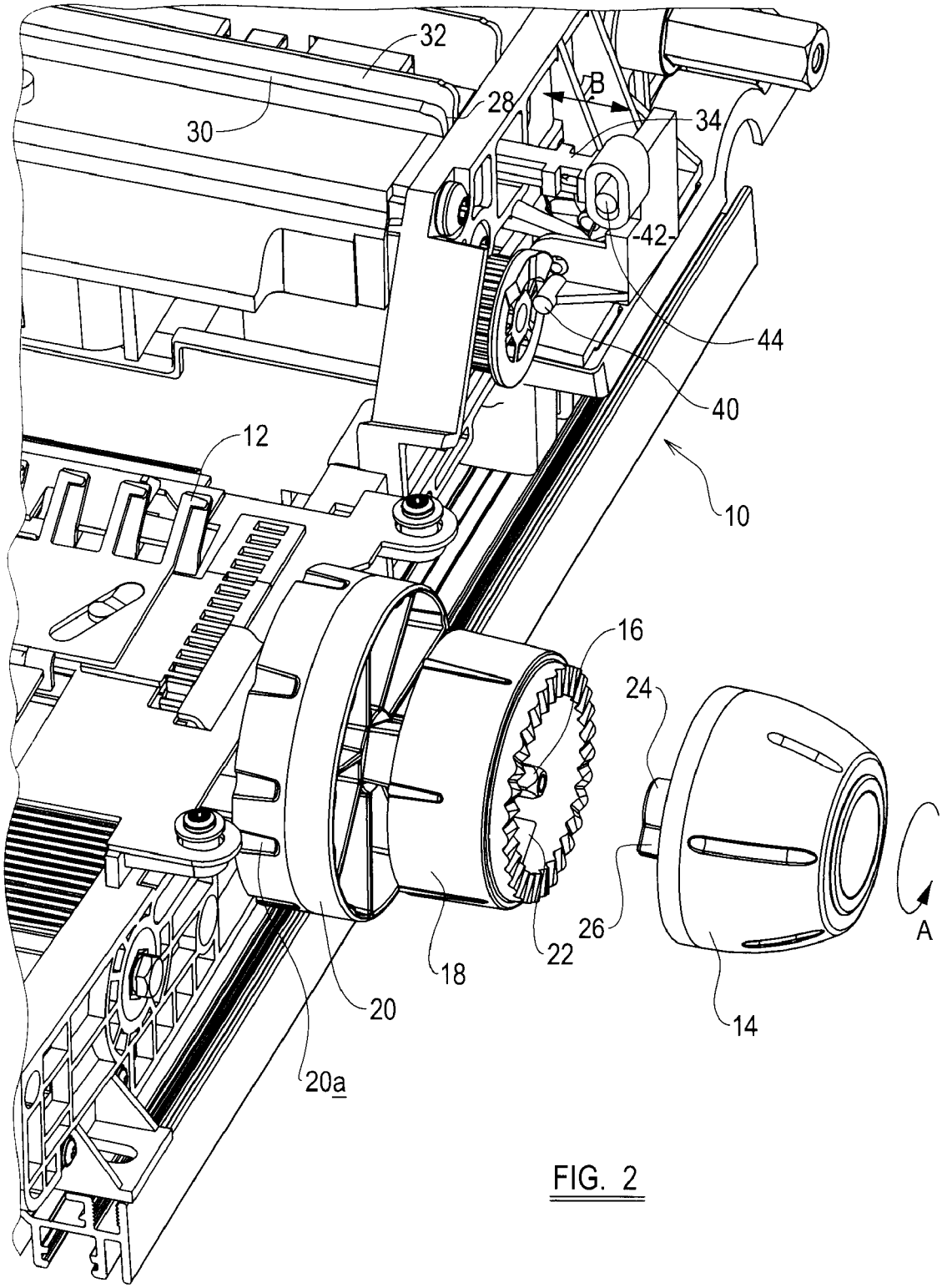
FIG. 2 is also a close up view of the right hand side of the binder of FIG. 1, but with a partially exploded view of the user operable controls.

Referring first primarily to FIGS. 1 and 2, the binder 10 includes a conventional comb opening mechanism, of the kind used in binders which employ such plastic combs, with fingers 12 which move forwards to open the comb when an outer user operable control 14 is rotated forwardly, (in the manner illustrated by arrow A). Forward rotation of the outer user operable control 14 rotates axle 16 which operates the comb opening mechanism, and thus moves the fingers 12 forwards which opens the comb. The punched pages of the document are placed on the teeth of the comb and the outer user operable control 14 is then rotated in backwardly, (in the opposite direction to arrow A) to release the comb, which as it is resilient then springs back to retain the pages of the document on the teeth.

However, if the fingers 12 move too far forwards for the size of comb being used then the teeth of the comb slip off the fingers 12 and the comb springs closed, which clearly makes it very difficult for the user to place the punched pages on the comb. The binder 10 according to the invention is therefore provided with a comb opening stop to prevent this occurring, as will now be described.

The binder 10 further includes an inner user operable control 18 which is secured for rotation with a selection wheel 20 which part is normally concealed within the outer casing 11 of the binder 10. The inner user operable control 18 and selection wheel 20 do not rotate with the axle 16. The outer user operable control 18 is marked with the various sizes of comb available and with which the binder is intended to be used, conveniently by displaying the different diameters of comb, but other manners of indication may be used as appropriate. Alternatively the markings relating to the size of comb may be located on the selection wheel and visible through a window in the outer casing 11 of the binder 10. The selection wheel 20 has located around its circumference a plurality of indentations 20*a*, into which a spring biased pin (not shown, it is located behind the selection wheel 20 as seen in FIGS. 1 and 2) to retain it in locations which correspond to available comb diameters.

As can be seen in FIG. 2, the inner user operable control 18 has within it a tongue 22 which protrudes radially inwardly from the outer edge. The outer user operable control 14 has a central boss 24 which receives the end of the axle 16. A tongue 26 extends radially outwardly from the boss 24. When the outer user operable control 14 is rotated forwardly to operate the comb opening mechanism and open the comb, the tongue 26 comes up against the tongue 22 which limits the movement of the outer user operable control 14, and thus limits the extent to which the comb is opened. The position at which the tongue 22 will be located will depend upon the size of comb selected by the user on the inner user operable control 18, and thus the comb will be opened to the correct degree for its size.

The binder 10 also includes a conventional back margin adjustment mechanism, which allows adjustment of the distance from the edge of the pages of the document at which the line of holes is punched. The holes are intended to be punched close to the edge of the pages for small diameter combs and further from the edge for larger diameter combs. In the prior art a small lever is provided for this adjustment to be implemented, but in general it is found that users fail to operate it, and all operations of such binders are conducted on the same back margin setting. The binder 10 according to the invention is therefore provided with a link between the back margin adjustment mechanism and the inner user operable control 18 to automatically alter the setting of the back margin adjustment mechanism with the setting of the inner user operable control 18 to prevent this occurring, as will now be described.

In conventional manner, pages to be punched are inserted into channel 28 between upstanding guides 30 and 32. At the base of the channel 28 are a series of fingers (not shown) running across the channel 28 on which the pages rest whilst being punched. The fingers are secured to a bar 34 which is moveable laterally of the binder 10 (as shown by arrow B). As the bar 34 is moved into the binder 10 the fingers run in slots which are angled downwards. A movement of the bar 6 mm inwards results in a downward movement of the fingers of 1 mm. A total inwards movement of 12 mm of the bar 34 is possible, and thus a total downward movement of the fingers of 2 mm can be achieved, enabling the back margin to be altered by 1 mm or 2 mm. Thus the bar, the fingers and angled slots within which they run form the conventional back margin adjustment mechanism.

The binder 10 further includes a toothed wheel (not shown, it is located behind the selection wheel 20 as seen in FIGS. 1 and 2) secured for rotation with the selection wheel 20. A second toothed wheel 36 is located close to the end of the bar 34, and a toothed belt 38 runs around the first and second toothed wheel, such that rotation of the first toothed wheel, achieved by rotation of the inner user operable control 18, results in rotation of the second toothed wheel 36. The outer face of the second toothed wheel 36 bears two cam surfaces 36*a* and 36*b*. A first peg 40 extends outwardly from a cam follower 42 which is mounted for pivoting movement about axis C, the first peg 40 being located below the axis C. A second peg 44 extends outwardly from an upper part of the cam follower 42 parallel to the first peg 40, but located above the axis C. The second peg 44 is located within an oval formation 46 secured to the end of the bar 34.

Rotation of the inner user operable member 18 rotates the selection wheel 20, and the first toothed wheel and thus causes the toothed belt 38 to drive the second toothed wheel 36. As the second toothed wheel 36 turns the first peg 40 is engaged by the first cam surface 36*a* and the first peg 40 is pushed outwardly such that the cam follower 42 pivots about axis C, and the second peg 44 moves inwardly towards the binder. This causes the second peg 44, located in the oval formation 46 to push the bar 34 inwardly and thus to operate the back margin adjustment mechanism. Further rotation of the inner user operable member 18 causes the first peg 40 to engage with the second cam surface 36*b* and thus for the first peg 40 to pushed further outwardly. This causes the cam follower 42 to pivot further about axis C, for the second peg 44 to move further inwardly and thus to push the bar 34 further inwardly, thus increasing the operation of the back margin adjustment mechanism. The first cam surface 36*a* causes an inward movement of the bar 34 of 6 mm, and the second cam surface 36*b* causes a further inward movement of the bar 34 of 6 mm, thus the two adjustments of 1 mm each in the distance of the holes from the edges of the pages are achieved.

Figure 3:
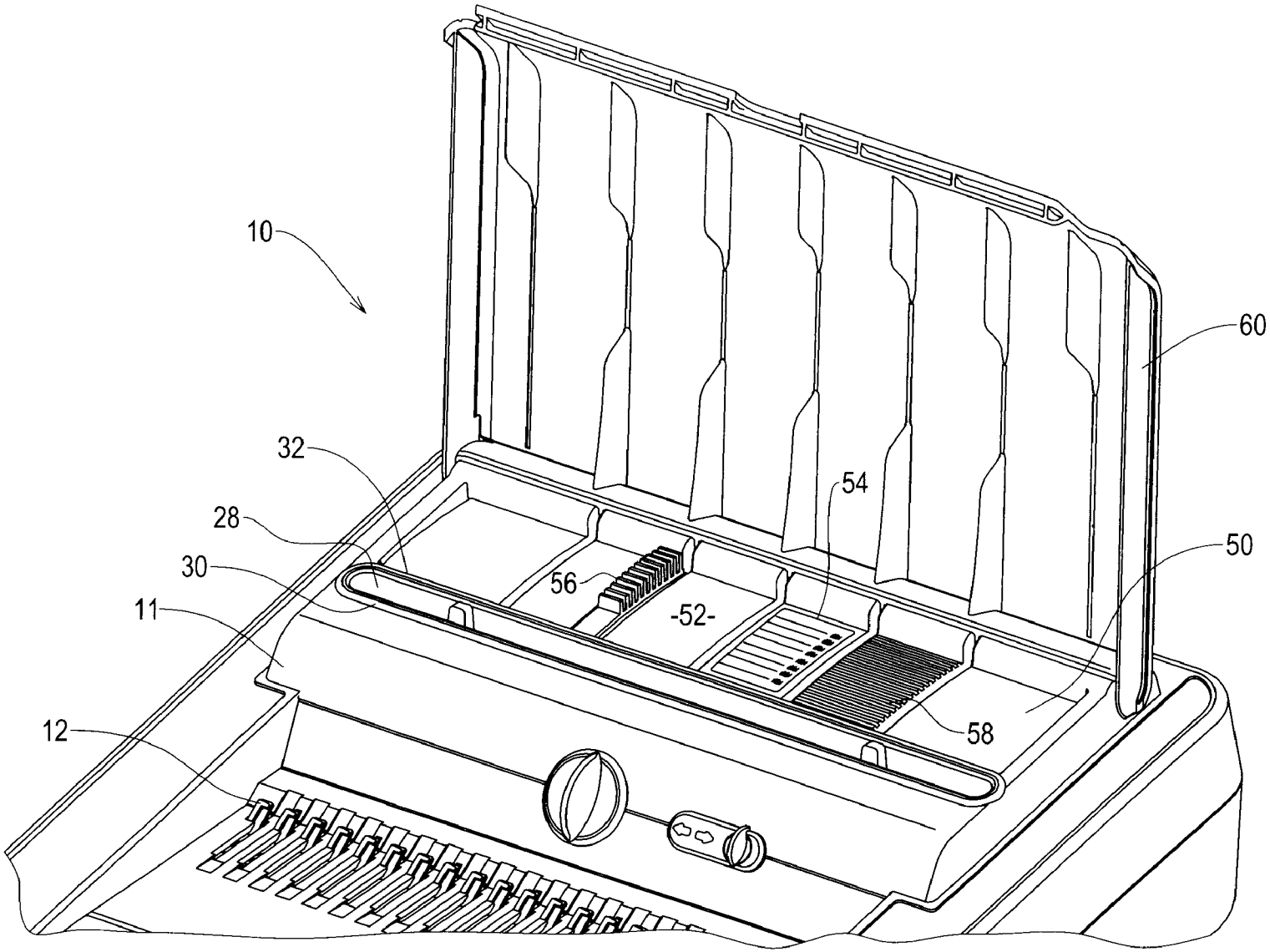
FIG. 3 is a perspective view of the binder of FIG. 1, showing a hopper.

Referring now to FIG. 3, the binder 10 is also provided with a hopper 50 which provides means for measuring the thickness of the document to be bound. The hopper 50 has a base 52 on which are provided a scale 54, comb 56, and an area of small parallel ridges 58. Adjacent to the hopper 50 is the hinged lid 60 of the binder 10, which when open as shown in FIG. 3 provides a support of the pages of the document when in the hopper 50. Thus the pages of the document to be bound are placed at the rear of the hopper 50, leaning against the open hinged lid 60.

The scale 54 enables the user to read off the document thickness, and with that information to decide on which size of comb to use to bind the document, and thus how to set the inner user operable control 18, which then determines the various settings of the binder as described above. Alternatively the scale 54 may show the appropriate comb size, and the user just selects the first comb size on the scale which is visible when the pages of the document are in the hopper 50.

The comb 56 divides the pages of the document up into groups of the size that can be punched at one time, with alternate groups standing up higher in a manner which makes it easy for the user to lift one group at once out of the hopper 50 for punching and binding. Thus the comb 56 assists the user in not overloading the punch mechanism, whilst undertaking as few punching operations as possible. The area of small parallel ridges 58 helps to prevent the pages of the document sliding forwards in the hopper 50.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A binder operable to bind together pages of a document using a comb, the binder including a punch mechanism operable to punch a line of holes close to one edge of the pages of the document, a back margin adjustment mechanism for setting the distance from the one edge of the pages of the document at which the holes are punched, and a comb opening mechanism to enable the punched pages to be placed on the comb, the comb opening mechanism having a user operable control, wherein the binder further includes:

a user operable control for selection of the comb size to be used to bind the document which automatically determines the setting of the back margin adjustment mechanism and at least one other setting of the binder.

2. A binder according to claim 1 wherein the binder further includes a comb opening stop for controlling the degree to which the comb is held open by the comb opening mechanism, and the setting of the user operable control for selection of the comb size automatically determines the setting of the comb opening stop.

3. A binder according to claim 2 wherein the user operable control for the comb opening mechanism has a first stop formation and the user operable control for selection of the comb size includes a second stop formation, the second stop formation limiting the movement of the first stop formation, and thus the user operable control for the comb opening mechanism, dependent upon the setting of the comb size.

4. A binder according to claim 1 wherein it further includes means for measuring the document thickness.

5. A binder according to claim 4 wherein the means for measuring the document thickness includes a hopper into which the pages of the document to be bound are placed.

6. A binder according to claim 5 wherein the hopper has within it a scale onto which the pages of the document to be bound are placed and from which the document thickness can be read by a user.

7. A binder according to claim 6 wherein the punch mechanism is capable of punching a group of pages at one time, and the hopper has within it a comb, having upstanding teeth and indentations therebetween, onto which the pages of the document to be bound are placed such that alternate groups of pages are supported in the indentations and on the teeth, such that the user can readily pick up a group at once for punching, and each group is of the correct number of pages to be punched at one time by the punch mechanism of the binder.

8. A binder according to claim 5 wherein the punch mechanism is capable of punching a group of pages at one time, and the hopper has within it a comb, having upstanding teeth and indentations therebetween, onto which the pages of the document to be bound are placed such that alternate groups of pages are supported in the indentations and on the teeth, such that the user can readily pick up a group at once for punching, and each group is of the correct number of pages to be punched at one time by the punch mechanism of the binder.

9. A binder according to claim 1 wherein a drive mechanism links the user operable control for selection of the comb size to the back margin adjustment mechanism.

10. A binder according to claim 9 wherein the drive mechanism includes a first toothed wheel secured for rotation with the user operable control for selection of the comb size, a toothed belt, a second toothed wheel driven by the belt, the second toothed wheel providing cam surfaces for operation of a cam follower to operate the back margin adjustment mechanism.

11. A binder according to claim 1 wherein the user operable control for selection of the comb size, or a part secured for rotation with it, is marked with the different diameters of comb available, and the user sets the control on the basis of the document thickness.

* * * * *

UNITED STATES PATENT AND TRADEMARK OFFICE

CERTIFICATE OF CORRECTION

PATENT NO. : 7,597,519 B2
APPLICATION NO. : 11/426052
DATED : October 6, 2009
INVENTOR(S) : Aries et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 187 days.

Signed and Sealed this

Twenty-eighth Day of September, 2010

David J. Kappos

David J. Kappos
*Director of the United States Patent and Trademark Office*